US007180721B2

(12) United States Patent
Schütz

(10) Patent No.: US 7,180,721 B2
(45) Date of Patent: Feb. 20, 2007

(54) PLASTIC BARREL AND METHOD FOR MANUFACTURING THE BARREL

(75) Inventor: Udo Schütz, Selters/Westerwald (DE)

(73) Assignee: Schütz GmbH & Co. KGaA, Selters/Westerwald (DE)

( * ) Notice: Subject to any disclaimer, the term of this patent is extended or adjusted under 35 U.S.C. 154(b) by 458 days.

(21) Appl. No.: 10/664,144

(22) Filed: Sep. 17, 2003

(65) Prior Publication Data

US 2004/0079754 A1 Apr. 29, 2004

(30) Foreign Application Priority Data

Sep. 17, 2002 (DE) ..... 102 42 955

(51) Int. Cl.
*H05F 3/00* (2006.01)

(52) U.S. Cl. ..... 361/212; 361/215

(58) Field of Classification Search ..... 361/212–215, 361/225–227; 264/104, 105, 537, 539; 220/4.12, 220/9.4

See application file for complete search history.

(56) References Cited

U.S. PATENT DOCUMENTS 4,848,566 A * 7/1989 Havens et al. ..... 206/719
5,759,649 A * 6/1998 Dinter et al. ..... 428/35.3

FOREIGN PATENT DOCUMENTS

DE 196 05 890 A1 8/1997
GB 2219270 A * 12/1989

* cited by examiner

*Primary Examiner*—Brian Sircus
*Assistant Examiner*—Danny Nguyen
(74) *Attorney, Agent, or Firm*—Friedrich Kueffner

(57) ABSTRACT

A plastic barrel, embodied as a bung barrel or a lid barrel, is manufactured as a single-layer container or multi-layer container by extrusion blow molding. The plastic barrel has a barrel body having an inner surface and an outer surface. The barrel body has sections integrated into the barrel body, wherein the sections are made of electrically conducting plastic material and form electric connections between the inner surface and the outer surface of the barrel body so that electric charges of the interior of the barrel can be dissipated to the outer surface.

17 Claims, 2 Drawing Sheets

Fig. 2
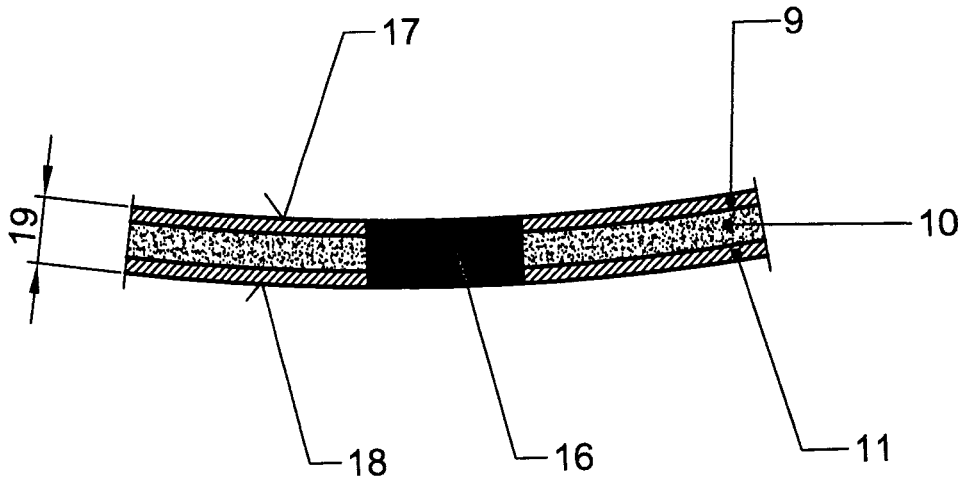
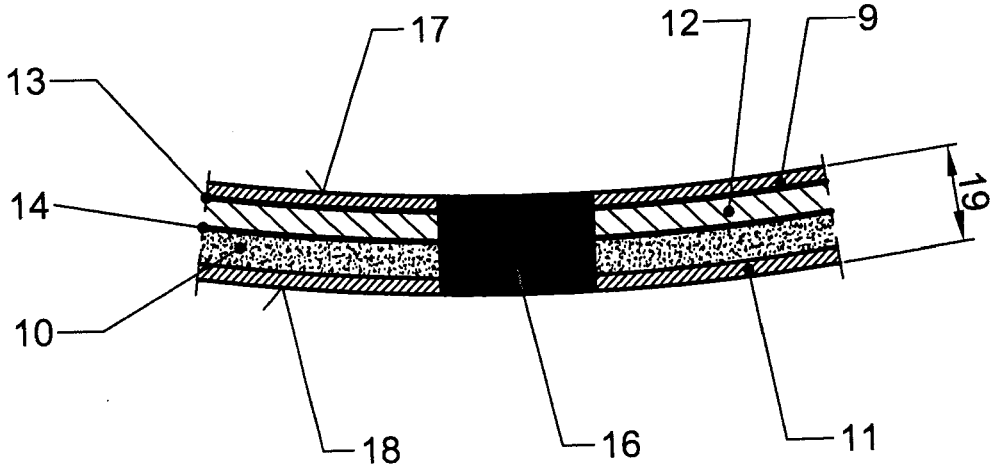
Fig. 3

PLASTIC BARREL AND METHOD FOR MANUFACTURING THE BARREL

BACKGROUND OF THE INVENTION

1. Field of the Invention

The invention relates to plastic barrels configured as bung barrels or lid barrels and produced as single-layer or multi-layer containers by extrusion blow molding.

2. Description of the Related Art

Plastic barrels of this kind, disclosed in DE 196 05 890 A1, for liquid or granular goods have a permanently antistatic outer layer in order to prevent electrostatic charging of the surface by friction of adjacently positioned barrels during transport. In this way, electrical discharge with spark generation, which could cause ignition of flammable goods contained in the barrels as well as of explosive mixtures of gases and vapors in closed rooms, is to be prevented, for example, in a situation when electrically conducting objects of metal are moved into close proximity of the barrel surface. This exterior grounding by means of a permanently antistatic outer layer of the plastic barrels cannot dissipate electric charges which are caused during filling and emptying of the barrels and stirring of liquids, for example, for mixing purposes, by friction of liquid on the inner surface of the barrel and by friction within the liquid itself.

SUMMARY OF THE INVENTION

It is an object of the present invention to further develop plastic barrels of the aforementioned kind for liquid and granular goods with regard to a safe and complete grounding action.

In accordance with the present invention, this is achieved in connection with the plastic barrel for liquid and granular goods such that the barrel is provided with sections, integrated into the barrel body and comprised of electrically conducting plastic material, which sections form an electric connection between the inner surface and the outer surface of the barrel body. In accordance with the present invention this is furthermore achieved with regard to the method according to a first embodiment by extrusion of a single layer or coextrusion of a multi-layer hose-shaped blank from a non-conducting base material, wherein the hose-shaped blank has strips comprised of an electrically conducting material and distributed about a periphery of the hose-shaped blank and by blow forming the hose-shaped blank to a barrel body in a blow mold, wherein the extrusion is carried out continuously or discontinuously. According to a second embodiment of the method, this is achieved by extrusion of a single-layer or coextrusion of a multi-layer hose-shaped blank, wherein the blank is extruded by the extruder head continuously or discontinuously; by splitting the blank at locations distributed about a periphery of the blank and by injecting into the resulting gaps an electrically conducting plastic material for forming strips, which fuse homogeneously with the material of the hose-shaped blank; and by blow molding the blank containing the strips to a barrel body in a blow mold.

The plastic barrel according to the invention has the following advantages. The strips comprised of electrically conducting plastic material and embedded in the non-conducting plastic material of the barrel body, embodied as a bung barrel or a lid barrel, have a thickness matching the wall thickness of the barrel and form electric connections between the inner surface and the outer surface of the multi-layer barrel provided with an outer permanently antistatic layer so that the electric charges present within the liquid goods contained in the barrel and on the inner surface of the barrel and resulting from friction of the liquid as well as the electric charges caused by friction on the outer surface of the barrel are dissipated into the ground via the electrically conducting strips in the barrel body and the permanently antistatic outer layer of the barrel. The limited use of expensive antistatic plastic material, for example, high-density polyethylene containing a proportion of conducting carbon black, for forming the electrically conducting strips and also the permanently antistatic outer layer of the plastic barrel, which is comprised otherwise of inexpensive plastic material, such as high-density polyethylene, results only in a minimal increase of the manufacturing costs. The electric grounding of the barrel surface and the interior of the plastic barrel as well as of the liquid to be transported or to be stored therein makes possible the utilization of the barrel as a container for hazardous (flammable) liquids and emulsions as well as solvents, paints, and lacquers with a flash point <35° C. as well as the use of the barrel in work rooms in which an explosive atmosphere can be formed comprised of gases, vapors, or mist.

BRIEF DESCRIPTION OF THE DRAWING

In the drawing:

FIG. 2 shows a partial cross-section of the barrel wall of the bung barrel according to FIG. 1 having a three-layer configuration; and FIG. 3 shows a barrel wall section, corresponding to the view of FIG. 2, of a bung barrel with a six-layer configuration.

DESCRIPTION OF THE PREFERRED EMBODIMENTS

Figure 1:
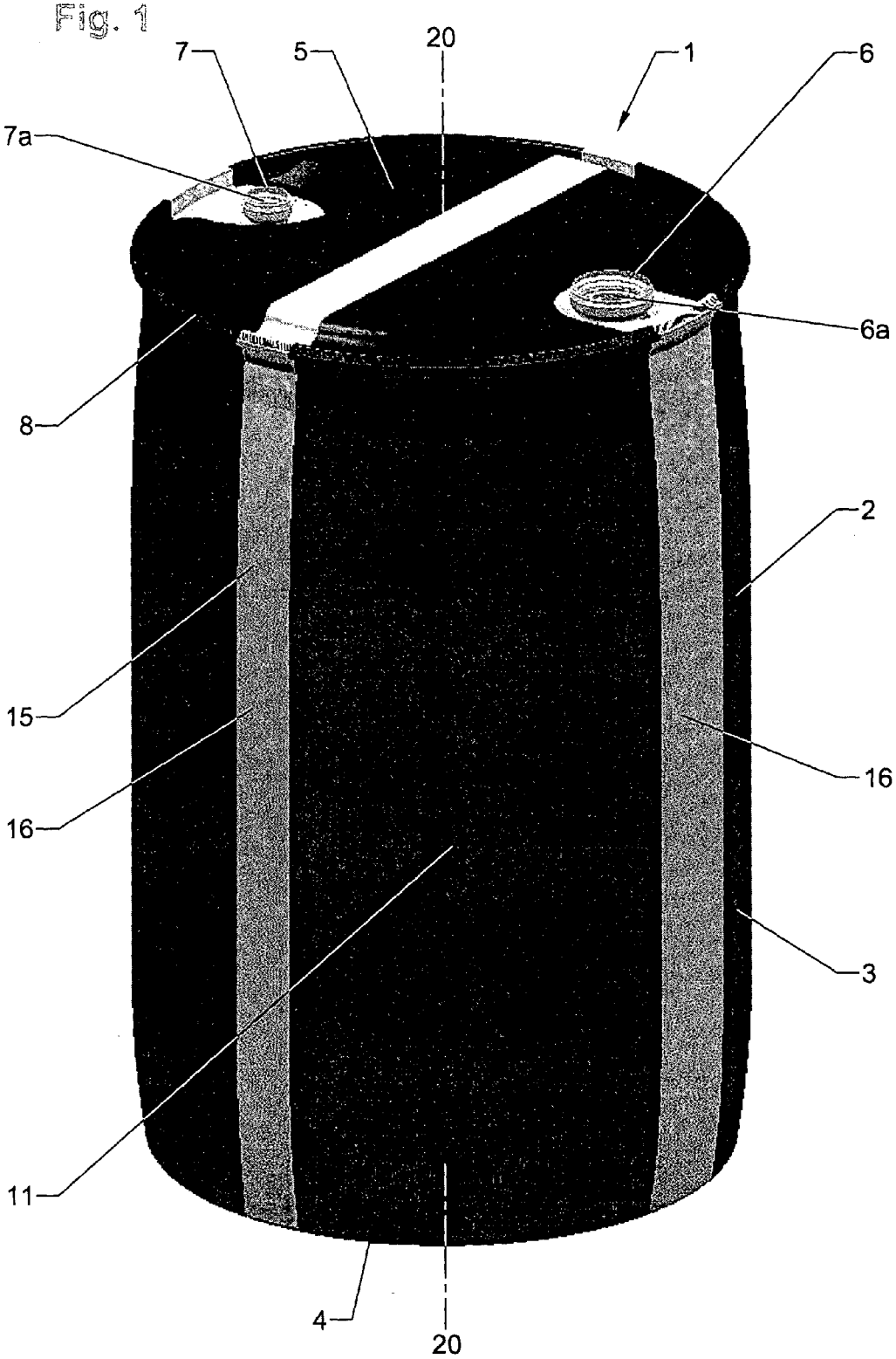
FIG. 1 shows a perspective illustration of a bung barrel.

The bung barrel 1, made of plastic material as a unitary or monolithic part by extrusion blow molding, wherein the plastic material is in particular high-density polyethylene, is comprised of a barrel body 2 comprising a cylindrical barrel jacket 3, a bottom 4, a top 5 with a filling and emptying bung 6 and a venting bung 7. The bungs 6, 7 are arranged recessed in the top 5 and have openings 6*a*, 7*a* that can be closed by bung plugs that are configured as screw plugs. The barrel body 2 also comprises an upper carrying ring 8 configured for attaching a gripping device and having an L-shaped cross-section.

FIG. 2 shows that the barrel jacket 3, the bottom 4, and the top 5 of the bung barrel 1 are comprised of an inner layer 9, a center layer 10, as well as a permanently antistatic outer layer 11 containing a proportion of conducting carbon black providing a specific surface resistance of less than or equal to $10^5$ Ohm and a specific volume resistance of less than or equal to $10^3$ Ohm. The thickness of the center layer 10 is 1 to 2 mm, preferably 1.5 mm, and the thickness of the inner layer 9 and of the outer layer 11 is 0.1 to 0.5 mm, preferably 0.2 mm.

For manufacturing the center layer 10, a recycled granular material or ground material of pure polyethylene and/or polyethylene containing conducting carbon black is used, and the starting material for the inner and the outer layers 9, 11 is new granular polyethylene material.

FIG. 3 shows a six-layer configuration of the bung barrel 1 with the inner layer 9 made of pure high-density polyethylene (HDPE); a barrier layer 12 of polyamide (PA) or ethylene vinyl acetate copolymer (EVA) provided against permeation of oxygen and hydrocarbons and embedded in two bonding agent layers 13, 14 of low-density polyethylene (LLDPE); a center layer 10 of recycled granular material or ground material of pure high-density polyethylene and/or high-density polyethylene containing conducting carbon black; as well as a permanently antistatic outer layer 11 of high-density polyethylene containing conducting carbon black.

In the barrel body 2 of the bung barrel 1, electrically conducting sections 15 in the form of strips 16 are integrated; they are made of high-density polyethylene containing a proportion of conducting carbon black and form an electrical connection between the inner surface 17 and the outer surface 18 of the bung barrel 1. Their thickness matches the wall thickness 19 of the bung barrel. The electrically conducting strips 16 (the light colored portions in FIG. 1) extend parallel to the longitudinal axis 20—20 of the barrel across the cylindrical barrel jacket 3 and radially across the bottom 4 and the top 5 of the bung barrel 1.

The bung barrel 1 is electrically grounded by means of the electrically conducting strips 16 and the permanently antistatic outer layer 11 so that electrical charges which occur on the inner surface of the barrel and in the liquid goods contained in the container as well as on the outer surface of the barrel are dissipated into the ground.

In the case of a lid barrel, the lid is injection molded of plastic material, in particular, high-density polyethylene containing conducting carbon black.

When manufacturing the bung barrel, first a multi-layer hose-shaped blank with strips distributed about the periphery is coextruded, wherein the base material of the blank is non-conducting material, in particular, high-density polyethylene, and the strips are made of an electrically conducting material, in particular, high-density polyethylene containing a conducting carbon black component, and, subsequently, the blank is blown in a blow mold to a barrel body, wherein the extrusion process can be carried out continuously or discontinuously.

A further method for producing the bung barrel is characterized by coextrusion of a multi-layer hose-shaped blank, wherein the hose-shaped blank is extruded continuously or discontinuously from the extruder head and is split at locations distributed about the periphery, wherein into the resulting gaps an electrically conducting plastic material is injected for forming strips that homogeneously fuse with the hose-shaped blank. Subsequently, the blank with the strips is blow molded to a barrel body in a blow mold.

While specific embodiments of the invention have been shown and described in detail to illustrate the inventive principles, it will be understood that the invention may be embodied otherwise without departing from such principles.

What is claimed is:

1. A plastic barrel, embodied as a bung barrel or a lid barrel, manufactured as a single-layer container or multi-layer container by extrusion blow molding, the plastic barrel comprising:

a barrel body having an inner surface and an outer surface;

the barrel body having sections integrated into the barrel body, wherein the sections are comprised of electrically conducting plastic material; and wherein the sections form electric connections between the inner surface and the outer surface of the barrel body, wherein the electrically conductive sections of the barrel body are strip-shaped and have a thickness matching a wall thickness of the barrel body.

2. The barrel according to claim 1, wherein the barrel body has a cylindrical jacket and wherein the sections extend parallel to a longitudinal axis of the barrel body across the cylindrical jacket of the barrel body.

3. The barrel according to claim 1, wherein the sections extend radially or diagonally across at least one of a bottom and a top of the barrel body.

4. The barrel according to claim 1, wherein the barrel body is a single-layer barrel body.

5. The barrel according to claim 1, wherein the barrel body is comprised of an inner layer and a permanently antistatic outer layer.

6. The barrel according to claim 1, wherein the barrel body is comprised of an inner layer, a center layer, and a permanently antistatic outer layer.

7. The barrel according to claim 6, wherein the barrel body further comprises a barrier layer and bonding agent layers, wherein the barrier layer is embedded in the bonding agent layers and is arranged between the inner layer and the outer layer of the barrel body.

8. The barrel according to claim 6, wherein the inner layer and the outer layer of the barrel body are comprised of high-density polyethylene, wherein new granular polyethylene is used for the inner layer and the outer layer and wherein the outer layer contains conducting carbon black.

9. The barrel according to claim 6, wherein the center layer of the barrel body is comprised of high-density polyethylene, wherein at least one of recycled granular or ground pure polyethylene and polyethylene containing conducting carbon black is used for the center layer.

10. The barrel according to claim 1, wherein the barrel body has a barrier layer, made of polyamide or ethylene vinyl acetate copolymer, and two bonding agent layers of low-density polyethylene, wherein the barrier layer is embedded in the two bonding agent layers.

11. The barrel according to claim 1, wherein the sections are comprised of high-density polyethylene containing conducting carbon black.

12. A method for manufacturing a plastic barrel comprising a barrel body having an inner surface and an outer surface, wherein the barrel body has sections integrated into the barrel body, wherein the sections are comprised of electrically conducting plastic material, wherein the sections form electric connections between the inner surface and the outer surface of the barrel body, and wherein the electrically conductive sections of the barrel body are strip-shaped and have a thickness matching a wall thickness of the barrel body; the method comprising the steps of:

extruding a hose-shaped blank of nonconducting base material, wherein the blank comprises strips distributed about a periphery of the blank and comprised of electrically conducting material, wherein the step of extruding is carried out continuously or discontinuously; and blow-molding the blank with the strips to the barrel body in a blow mold.

13. The method according to claim 12, wherein the extruding step includes extruding a single layer hose-shaped blank of non-conducting base material.

14. The method according to claim 12, wherein the extruding step includes coextruding a multilayer hose-shaped blank of non-conducting base material.

15. A method for manufacturing a plastic barrel comprising a barrel body having an inner surface and an outer surface, wherein the barrel body has sections integrated into the barrel body, wherein the sections are comprised of electrically conducting plastic material, wherein the sections form electric connections between the inner surface and the outer surface of the barrel body, and wherein the electrically conductive sections of the barrel body are strip-shaped and have a thickness matching a wall thickness of the barrel body; the method comprising the steps of:

extruding a hose-shaped blank in an extruder head, continuously or discontinuously;

splitting the blank exiting the extruder head at locations distributed about a periphery of the blank;

injecting an electrically conducting plastic material for forming strips in the blank into gaps resulting from splitting, wherein the plastic material injected into the gaps fuses homogeneously with the material of the blank; and subsequently, blow molding the blank provided with the strips to the barrel body in a blow mold.

16. The method according to claim 15, wherein the extruding step includes extruding a single layer hose-shaped blank of nonconducting base material.

17. The method according to claim 15, wherein the extruding step includes co-extruding a multilayer hose-shaped blank of non-conducting base material.

* * * * *